United States Patent [19]

Greco

[11] 4,388,790

[45] Jun. 21, 1983

[54] PARTITION AND PANELING SYSTEM

[76] Inventor: Michael Greco, 14 Woodlands La., White Plains, N.Y. 10607

[21] Appl. No.: 278,638

[22] Filed: Jun. 29, 1981

[51] Int. Cl.[3] ..... F16B 5/06; E04C 1/10; E04C 1/30; E04H 1/00

[52] U.S. Cl. ..... 52/584; 52/241

[58] Field of Search ..... 52/241, 584, 582, 143, 52/300, 122

[56] References Cited

U.S. PATENT DOCUMENTS

| | | | |
|---|---|---|---|
| 2,453,221 | 11/1948 | Haden | 52/584 |
| 3,300,926 | 1/1967 | Heirich | 52/300 |
| 3,430,997 | 3/1969 | Propst | 52/584 |
| 3,453,790 | 7/1969 | Harris | 52/143 |
| 3,601,356 | 8/1971 | Yurich | 952/584 |
| 3,605,363 | 9/1971 | Bard | 52/584 |
| 3,626,652 | 12/1971 | Hanley | 52/584 |
| 3,671,063 | 6/1972 | Slayden | 52/584 |
| 3,726,523 | 4/1973 | Nielsen | 52/584 |
| 4,277,920 | 7/1981 | Dixon | 52/241 |
| 4,329,820 | 5/1982 | Wendt | 52/241 |

FOREIGN PATENT DOCUMENTS

| | | | |
|---|---|---|---|
| 2349845 | 4/1973 | Fed. Rep. of Germany | 52/584 |

*Primary Examiner*—Reinaldo P. Machado
*Attorney, Agent, or Firm*—Spellman & Joel

[57] ABSTRACT

A partition and paneling system comprises connecting means for joining of abutting wall panels together to form an integral wall. The connecting means includes a head section supporting the ceiling and connected to the conventional overhead steel work or black iron. Downwardly extending top guide channels are mounted to the head section and the upper portion of a fastening member is located within the top guide channels and extends downwardly therefrom. The fastening member comprises an enlarged upper portion, an elongated intermediate portion having tapered wedged-shaped blocks at intermediate portions therealong and a lower enlarged portion having a threaded axial aperture which is engaged by a threaded rod. The rod is locked in the lower enlarged portion at one end and has an outwardly extending block at the lower end thereof and an elongated lock nut mounted thereto. The transverse block portion cooperates with stop blocks in a base mounting channel to tighten the wedge-shaped portions into mating elements mounted on the edges of a abutting wall panels. Thus, the abutting partitions or panels are drawn into contact with one another by merely tightening on the elongated lock nut of the fastening member. The partitions may similarly be readily released by unlocking the nut thereby loosening the fastening member so that the panels can be reused.

11 Claims, 5 Drawing Figures

PARTITION AND PANELING SYSTEM

BACKGROUND OF THE INVENTION

The present invention relates to a partition and paneling system for assembling walls and particularly to a system whereby wall partitions may be readily assembled and disassembled for reuse.

The conventional method of installing walls at commercial job sites involves the use of dry walls. Such installations require at least 5 independent trades or contractors such as a carpenter for studs, gypsum faces, door bucks and doors; a spackler for taping, spackling and sanding; a floor covering contractor for the base and a ceiling contractor to set the wall angle which receives the ceiling. A painter or paper hanger is also required for painting and vinyl covering and an architectural wood contractor if paneling is required. Even with the considerable amount of work involved, the dry walls are almost never straight, plumb, or even.

In contrast to conventional dry wall construction, the wall produced by this invention requires only one trade and the wall can be reused or recycled. The wall is non-bearing, studless, absolutely flush and permits atmospheric expansion. The wall is also assembled straight, plumb and even by a rapid inexpensive method. The system is ideal for a modular space design and individual panels can be removed separately in case of damage or the necessity for future utility work.

While the present invention is intended to provide a partition and paneling system to replace the usual dry wall installation which is the current commercial standard, other reusable wall systems do exist but are not believed pertinent to the present invention. For example, U.S. Pat. No. 3,381,438 to J. A. Bohnsack discloses a reusable wall system but the details thereof are completely different from the present invention. Other prior art which is somewhat relevant includes U.S. Pat. Nos. 3,453,790 to D. S. Harris, 3,300,926 to W. C. Heirich and U.S. Pat. No. 3,293,282 to S. T. Lewis et al. There is additional prior art but it is believed to be merely cumulative to the references previously cited and not directly relevant to the present disclosure.

The present invention as distinguished from the prior art discloses a new and improved partition system which involves a unique structure and method of assembly. The invention as described hereinafter has many advantages over the prior art and represents an important advance in this area.

SUMMARY OF THE INVENTION

The present invention relates to a new and improved partition and paneling system and particularly to a new and improved wall construction system involving unique fastening means.

The partition and paneling system of the present invention can be recycled or reused and is particularly advantageous in modular arrangements. Consequently, the system is ideal for commercial buildings where standard or modular offices are used and where office rearrangement is a constant fact of life. The wall design employed in the present system is quite flexible.

The thickness of the wall can vary from 4" to any thickness depending upon the amount of fireproofing or soundproofing required. Importantly, the walls are non-bearing, studless and absolutely flush. Atmospheric expansion is also taken into account so that the flush appearance is maintained. The wall panels can be removed separately for future additional work such as changing the panels or adding new phone or electrical wires or working on plumbing lines. The system eliminates the normal disruption which occurs in commercial establishments during such activities.

The face of the partition may be of any material such as wood, plastic, metal or laminate or vinyl fabric as long as the rear face will accept fasteners. The panels may be shipped directly to the job site together with the bases since there is no machining of edges required. The invention may be used under severe conditions where, for example, the uneveness of the floor can range up to 1½". In practice, the partition height is determined from the high level of the entire space and the partition is set level and in the base scribed to the low areas.

The system comprises means for joining wall sections in an abutting relationship to form a continuous wall. Overhead, the system includes a head section which is coupled to the black iron structural work by means of angle clips and which includes top guide channels extending downwardly therefrom. On its lower end, the system includes a base mounted to the floor with bottom channels extending upwardly therefrom and having leveler means for adjusting the level of the channels to compensate for uneveness of the floor. Complementary wedge-shaped members are mounted on adjacent panels at pre-determined intervals to engage fastening means which join adjacent panels together.

The fastening means comprises an elongated member having a enlarged block at its upper end which engages the top guide channels and shaped members at intervals therealong to mate with corresponding adjacent members mounted on the walls. The lower portion of the fastening means comprises a enlarged block portion having a threaded aperture extending axially from its base. A threaded rod is mounted within the threaded aperture of the lower enlarged block and includes a lock nut at the end thereof to maintain the enlarged block in position a transverse block is threaded onto the rod and is designed to engage bottom stop blocks in the lower channel members. A longitudinally extended lock nut is threaded onto said rod to drive the wedge-shaped members into engagement with their mating members on the adjoining or abutting panels as the nut is tightend against the stop blocks. This permits rapid installation and disassembly of the panels without damage thereto so that they can be reused in other installations or replaced as required.

Accordingly, an object of this invention provide a new and improved wall partition system.

Another object of this invention is to provide a new and improved partition system having a unique fastening means which joins adjacent panels together.

A further object of this invention, is to provide a reusable partition system which provides straight, plumb and even walls with panels that can be readily removed separately for future additional work.

A more specific object of this invention is to provide a new and improved partition system having fastening means which comprises an elongated member having coupling means which engages mating coupling means on the panels and means for bringing said respective coupling means into engagement with one another in a simple and expeditious manner to form a flush integral wall.

BRIEF DESCRIPTION OF THE DRAWINGS

Other objects and advantages of the present invention will be more clearly seen when viewed in conjunction with the accompanying drawings wherein.

DETAILED DESCRIPTION OF THE INVENTION

Figure 1:
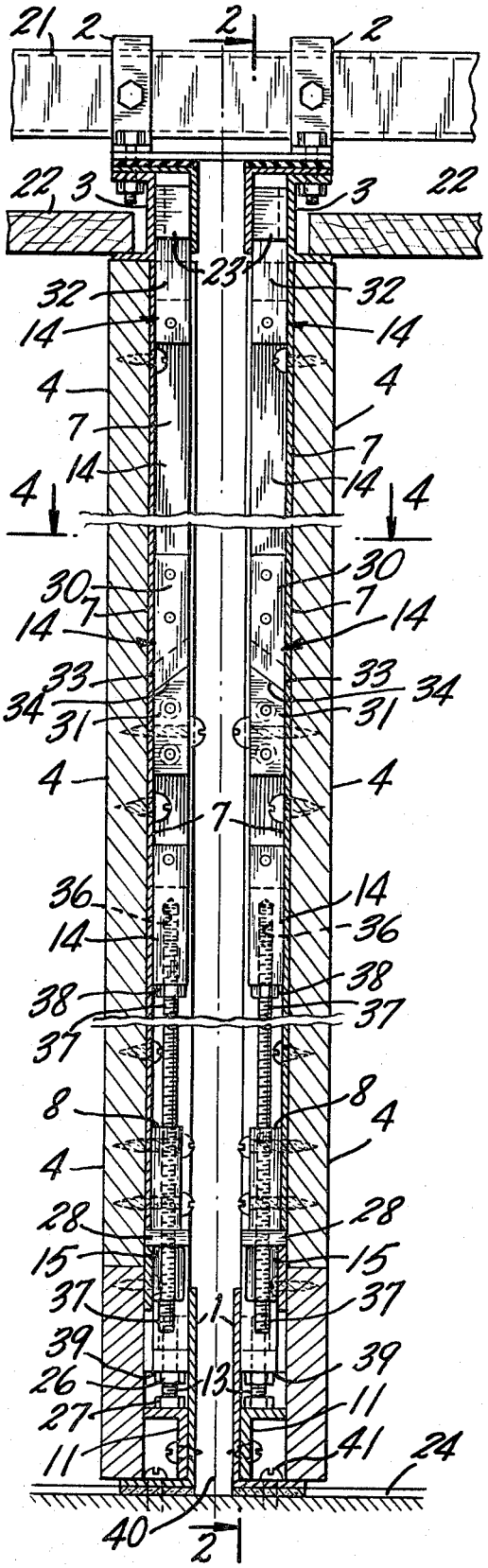
FIG. 1 is a front view of the partition and paneling system in use with parts thereof shown in cross section.
Figure 3:
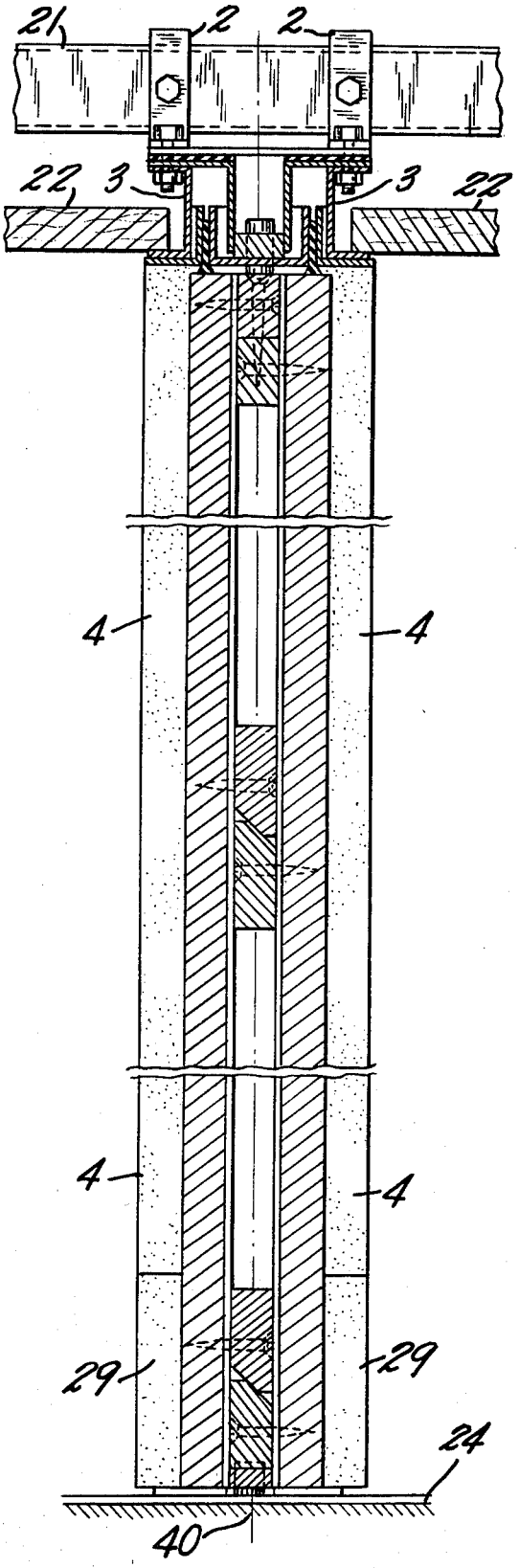
FIG. 3 is a sectional view of the invention taken along the line 3—3 of FIG. 4.
Figure 2:
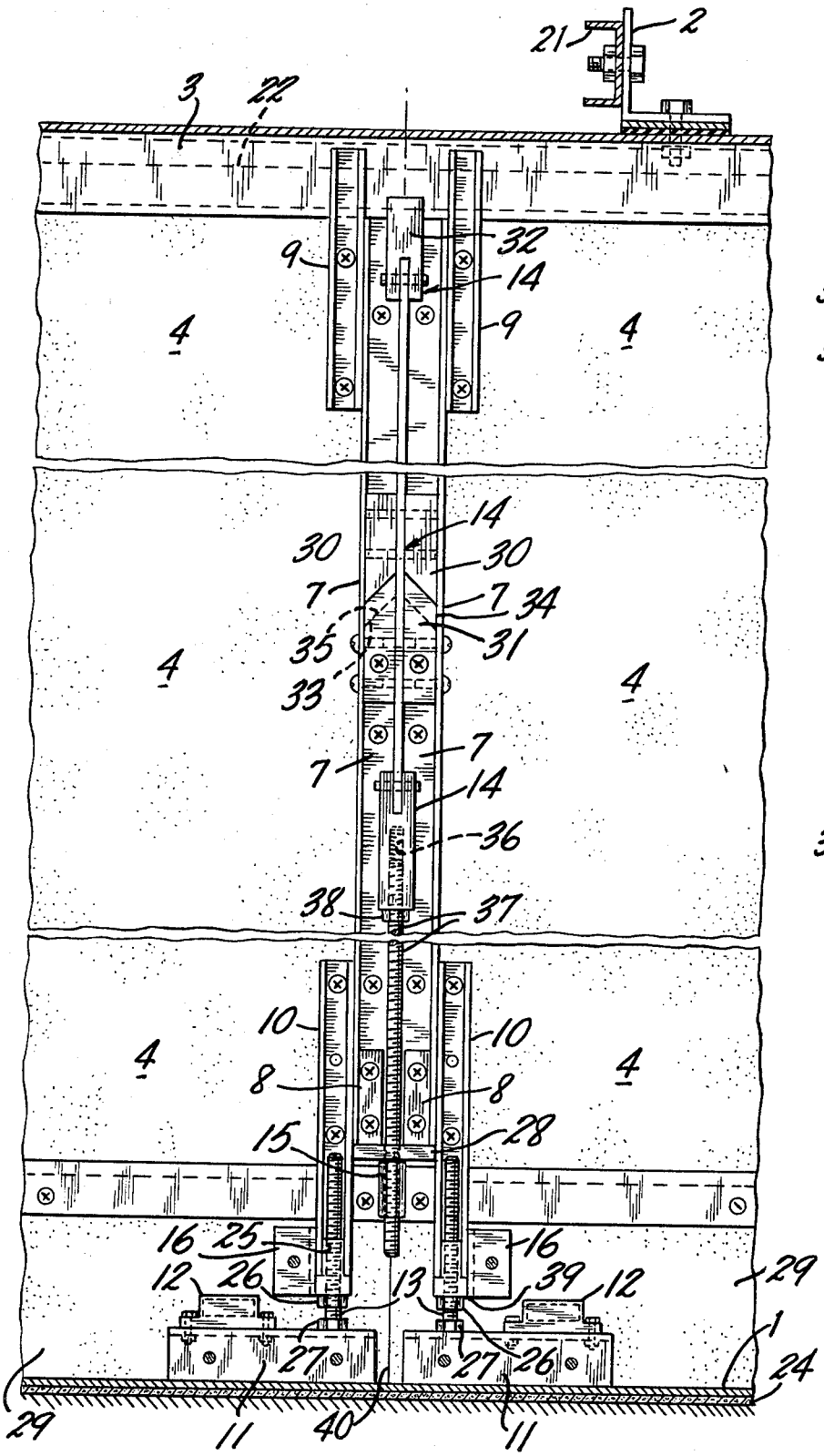
FIG. 2 is a sectional view of the invention along the line 2—2 of FIG. 1.
Figure 5:
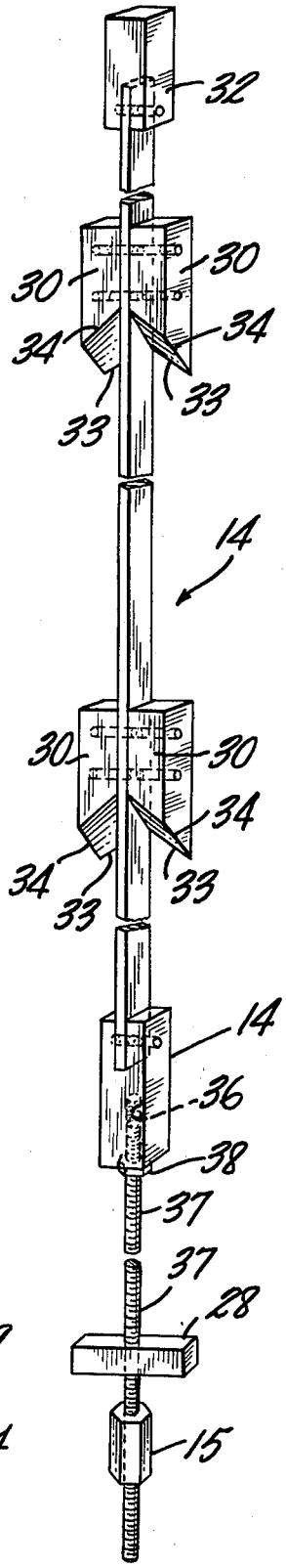
FIG. 5 is a view illustrating the fastening means used to join adjacent panels together to form an integral wall arrangement under the system of the present invention.
Figure 4:
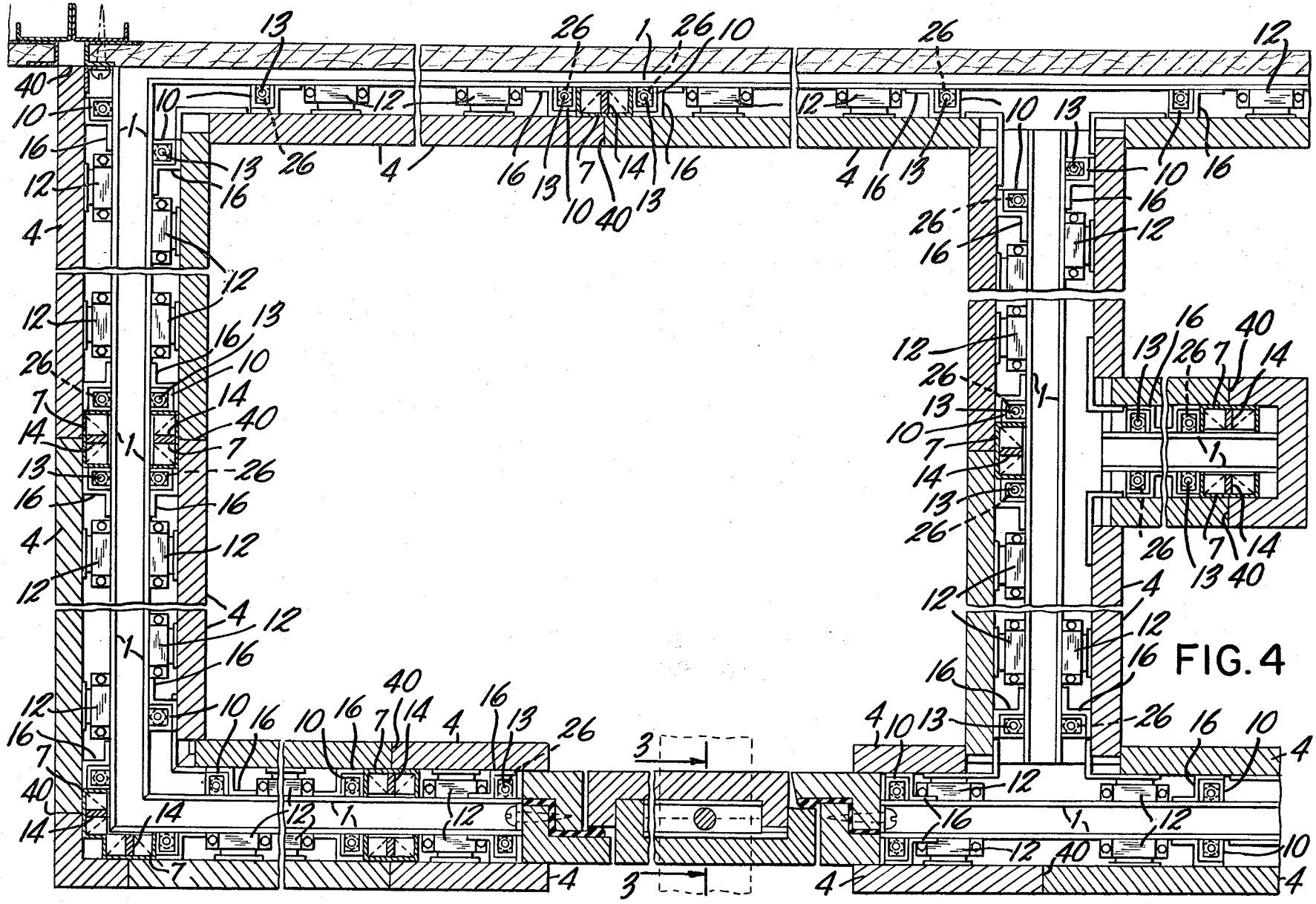
FIG. 4 is a plan view of the invention taken along the line 4—4 of FIG. 1.

Referring now to the drawings, the invention comprises a partition and paneling system of a reusable nature which is particularly suited for modular installations. According to the invention, black iron angle clips 2 are secured to the conventional black iron structure 21 running overhead. A head section 3 is bolted to the clips 2 and supports the ceiling 22. A pair of top guide channels 9 are mounted on adjacent panels 4 at their upper end within the head channel 23.

At the base or floor 24 angles 1, are mounted and include connected angles 11 on which levelers 13 are supported. One bottom channel 10 is mounted on each panel. Each elongated leveler channel 10 includes an axial aperture 25 having a threaded member 13 with nuts 26 and 27 its base 39 for leveling said channels 10 against angle 11.

The panels 4 are leveled by turning the nuts 26 in the leveler screw assembly 13 to raise or lower the channel guides 10. The magnets 12 are mounted on angle 11 and are required to hold the base 29 of the fastening means 14 in place during the installation operation. A pair of stop blocks 8 are installed flush with the bottom of the joint connector angles 7 on members 30 and 31 and engage transverse member 28 which cooperates with lock nut 15 and a threaded portion 37 of the fastener or fishtail connector 14 to drive connectors 30 into engagement with the connectors 31 mounted on the back of the panels 4, The fastening member 14 is an elongated member having an upper block portion 32 which engages the top guide channels 9 and intermediate fishtail connectors 30 which mate with the connectors 31 on adjacent panels 4 to secure the panels 4 firmly in place. The spaced fishtail connectors 30 comprise a tapered lower portion 33 having an inclined upwardly extending face 34 which is driven into engagement with the mating surface 35 on members 31 by the lock nut 15. As the lock nut 15 applies pressure against the stop blocks 8 by means of transverse member 28 the connectors 30 are driven downwardly.

The lower portion of the fastening means includes an enlarged portion 14 having an axial aperture 36 which is engaged by a threaded rod 37 with the lock nut 38 at its lower end. The threaded portion 37 extends through the bottom level channels 10 and the transverse member 28 which engages the stop blocks 8. The wall system, as noted previously, is particularly suited for modular installations in commercial buildings. In such instances, the wall system would be constructed on four foot modules. The modular grid would be marked on the floor and construction commenced.

In a typical installation, the black iron 21 would be installed in both directions so that it is rigid and level. One direction is all at the same height and the other is wired over it at right angles. All the electrical, telephone, plumbing and any other work can now be roughed in. The trades can now be more exact in their work since the field dimensions are exactly established.

The floor angles are fastened by either screws and plugs or by gun shot nails 41. The floor angle 1 is cut short exactly $1\frac{5}{8}''$ from the jamb opening of any doors. It is not necessary to make the floor angle 1 level but it is important to set it at the exact dimension from the module line 40.

The black iron angle clips 2 are temporarily clamped to the black iron 21. The height need not be precise at this point but it is important to clamp them exactly with respect to the module line 40. The head section 3 is bolted to the ceiling angle clips 2. The height need not be precise at this point but it is important to be set at the exact dimension from the Module Line 40. The head section is continuous, even through the door openings.

The joint connector angles 7 are fastened vertically on the back of the panels 4 flush with the edge and top and about $\frac{5}{8}''$ short at the bottom. Additional vertical angles 31 are mounted vertically on the back of the panels 4, plus or minus 2'-0" on center. These as well as the joint connector angles 7 are the panel stiffeners.

The bottom stop blocks 8 are fastened flush with the end of the joint connector angles 7. Next, the top guide channels 9 are fastened at the top against the connector angles and extend approximately $1\frac{1}{4}''$ from the top of the panel. The bottom level or channels 10 are similarly fastened against the connector angles and extend approximately $1\frac{3}{4}''$ form the bottom of the panel.

At this time, the panel has all the parts fastened to the back and is ready for setting. If there is any sound proofing insulation required, it can now be installed between the stiffeners. Prior to setting the panel 4, the angle on which the levelers are supported 11 is fastened to the floor angle 1. The angles are installed $\frac{1}{2}''$ away from the module line 40. Before installing this angle, a magnet 12 is mounted to each one to hold the base in place at a later time.

During the setting of the panel insert, the leveler screw assembly 13 is inserted inside the bottom leveler channel 10. The top guide channels are now guided 9 into the head channel 3 and rest the panel 4 on the levelor support angles 11. The panel 4 is leveled by turning the leveling assembly nut 26. When level, the lock nut 27 is tightened. The panel 4 is perfectly level when the dimension from the bottom of the panel measures equally at both edges to the established bench mark.

Before setting the next panel, the top of the fishtail connector 14 is inserted into the head guide channel 3 and nested into the connector angle 7. The connector 14 is designed and manufactured so that it will hold in the up position. At this time, the lock nut coupling unit 15 should be clear of and under the bottom stop blocks 8. The adjacent panel is set as explained above and the joint between the two panels is made, as close together as possible. This joint should also be on the module line. The lock nut coupling 15 is tightened making sure that it is applying pressure to stop blocks 8. The nut is turned until it mates the fish tails of members 30 and 31. This procedure should hold the joint tight and the faces of both panels 4 flush or even.

The "Z" angle clips 16 are now fastened to the floor angle 1 with the screws provided. After a series of panels have been set in the manner described above the black iron clips 2 are bolted securely. The ceiling channels 3 are pressing tight on the top of the panels 4 at this time. The assembly is now complete and the wall system is in place. The wall system or any panel 4 can nevertheless can be readily removed for repair or reuse.

The invention may also be used in adding or subtracting panels from table tops. It is thus possible to readily provide an integral flush table in conference rooms of a size appropriate to the meeting group. Fishtail connectors would engage mating elements on the bottom of the table leafs to hold the parts together.

It is understood that the above-described arrangements are merely illustrative examples of the application. Numerous other arrangements may be readily devised by those skilled in the art which will embody the principles of the invention and fall within the spirit and scope thereof.

What is claimed is:

1. A partition system wherein wall panels may be secured to the ceiling support and floor and in an abutting relationship to each other to form a continuous wall comprising:

a head section coupled to the ceiling support and including top guide channels extending downwardly therefrom with a recess therebetween, at least one joint connector angle mounted on the rear edge of adjacent wall panels a base mounted to the floor and having bottom channel members extending upwardly therefrom, and, stop blocks extending inwardly within the channel aperture, fastening means mounted within the top guide channel at its upper end and the bottom guide channel at its lower end and having a fishtail-shaped connector mounted at an intermediate portion to engage each joint connector angle, and, means for moving the fastening means in a direction to bring about locking engagement of the joint connector angle and the mating connector.

2. A wall partition system in accordance with claim 1 wherein:

the joint connector angle comprises a mirror image block mounted on the edge of adjacent panels, each having an upper surface sloping inwardly and upwardly and at an angle to a horizontal plane.

3. A wall partition system in accordance with claim 2 wherein:

the fastening means comprises an elongated member having an enlarged portion at its upper and lower ends engaging respectively the top guide channels and the bottom channel members to hold said means in position and the fishtail connector comprises a block having a lower surface sloping inwardly and upwardly and at an angle similar to that of the joint connector angle surface.

4. A wall partition system in accordance with claim 1 wherein:

the fastening means comprises an elongated member having an enlarged portion at its upper and lower ends engaging respectively the top guide channels and the bottom channel members to hold said means in position and the fishtail connector comprises a block having a lower surface sloping inwardly and upwardly and at an angle similar to that of the joint connector angle surface, and, further including an enlarged intermediate portion having threaded axial aperture and a threaded rod engaging said aperture and extending downwardly therefrom into the aperture between the stop blocks and having said lower enlarged portion engaging the bottom of the stop blocks and a lock nut to drive said fastening means downwardly and the connectors into engagement.

5. A wall partition system in accordance with claim 1 further including:

means for leveling the bottom channel members to maintain the fastening means in a vertical position.

6. A wall partition system in accordance with claim 5 wherein:

the base includes floor angles mounted to the floor and extending upwardly and having a base angle having one surface mounted to the vertical position thereof and a second surface extending outwardly in a horizontal direction to provide a surface for engagement with the leveling means.

7. A wall partition system in accordance with claim 1 further including:

magnet means mounted on the upper surface of the base to hold said base in place during assembly.

8. A wall partition system in accordance with claim 5 wherein:

the bottom channel members are each connected to an adjacent panel each include a threaded axial aperture, and, the leveling means comprises a threaded member engaging each of said apertures and each having a lower head and a nut engaging the bottom of the channel member to permit vertical movement of a particular channel member and adjustment of the attached panel.

9. A wall partition system in accordance with claim 1 wherein:

the head section comprises an upper portion mounted to the supports, an intermediate portion for supporting ceiling members and a pair of downwardly extending top guide channels, each on an adjacent panel and forming a space therebetween to accomodate the fastening means.

10. A wall partition system in accordance with claim 1 wherein:

the partition system includes a plurality of joint connector angles spaced approximately two feet apart vertically on centers and the fastening means includes a corresponding plurality of fishtail connectors.

11. A wall partition system in accordance with claim 1 wherein:

the wall panels are mounted in a spaced double wall arrangement with the fastening means in the interior space thereof.

* * * * *